US005287969A

United States Patent [19]

Kehr

[11] Patent Number: 5,287,969

[45] Date of Patent: Feb. 22, 1994

[54] ORIENTATION-INSENSITIVE SHIPPING CARTON

[75] Inventor: Roger F. Kehr, Huntington Valley, Pa.

[73] Assignee: Any Side Up, Inc., Horsham, Pa.

[21] Appl. No.: 969,437

[22] Filed: Oct. 30, 1992

[51] Int. Cl.[5] ..... B65D 81/02

[52] U.S. Cl. ..... 206/583; 47/67; 119/52.2; 248/182; 248/184

[58] Field of Search ..... 206/521, 583; 119/52.1, 119/52.2, 57.8, 57.9; 47/66, 67, 84; 248/182-186, 179

[56] References Cited

U.S. PATENT DOCUMENTS

| | | | |
|---|---|---|---|
| D. 250,376 | 11/1978 | Schoenbrun | 47/67 X |
| 1,624,504 | 4/1927 | Pfarr | 47/67 |
| 2,133,489 | 10/1938 | Smith . | |
| 2,493,043 | 7/1945 | Stipsky . | |
| 2,681,783 | 6/1954 | Smith . | |
| 2,864,174 | 12/1958 | Hurlburt et al. . | |
| 2,885,565 | 5/1959 | Davis . | |
| 3,265,200 | 8/1966 | Omer . | |
| 3,349,630 | 10/1967 | Seliger et al. . | |
| 3,559,870 | 2/1971 | Petruzzelli et al. . | |
| 3,656,649 | 4/1972 | Martin | 248/184 X |
| 3,873,017 | 3/1975 | Blatt . | |
| 3,948,220 | 4/1976 | Fiedler | 119/57.8 X |
| 3,977,594 | 8/1976 | Swan | 229/108 X |
| 4,189,122 | 2/1980 | Miller . | |
| 4,292,854 | 10/1981 | Liebing . | |
| 4,436,188 | 3/1984 | Jones . | |
| 4,472,978 | 9/1984 | Levine et al. . | |
| 4,844,327 | 7/1989 | Pausing | 229/110 X |
| 4,951,521 | 8/1990 | Jacobson . | |
| 4,954,094 | 9/1990 | Humphrey . | |
| 5,007,541 | 4/1991 | Gunn et al. . | |
| 5,062,239 | 11/1991 | Helton | 47/67 X |
| 5,078,272 | 1/1992 | Combs . | |

FOREIGN PATENT DOCUMENTS

| | | | |
|---|---|---|---|
| 0763201 | 9/1980 | U.S.S.R. | 206/583 |

*Primary Examiner*—Bryon P. Gehman

*Attorney, Agent, or Firm*—Shoemaker and Mattare, Ltd.

[57] ABSTRACT

A shipping container includes a hexagonal carton having six walls extending between top and bottom ends of the carton, and a gimbal assembly contained within the carton and supported only by pivot connections to an opposed pair of the walls. The gimbal assembly comprises a normally horizontal ring supported by the pivot connections to the side walls, a normally vertical cradle pivotally connected at diametrically opposed points to the ring, and a product platform connected to the cradle below its pivot axis. Since the cradle and product platform have a combined center of gravity below the pivot axis, the cradle tends to remain in a vertical plane regardless of how the carton is turned. The top and bottom ends are preferably formed by six triangular flaps each slightly oversize, so that the flaps toggle to a locked, non-coplanar position upon closure.

8 Claims, 3 Drawing Sheets

ORIENTATION-INSENSITIVE SHIPPING CARTON

BACKGROUND OF THE INVENTION

This invention relates generally to containers, and more particularly to a carton including a gimbal-type support for holding contents of the container upright, regardless of how the carton is turned.

Gimbal mounts, generally, were of course previously very well known, for use with compasses and a variety of other instruments. At least one prior inventor (Martin, U.S. Pat. No. 3,656,649) has proposed a shipping crate having a gimbal mounting for supporting a delicate instrument within the crate.

SUMMARY OF THE INVENTION

An object of the invention is to enable one to ship orientation-sensitive devices or goods ("products") in a carton, without fear that the contents of the carton may be damaged by improper turning of the carton.

Another object of the invention is to provide a cardboard shipping carton and gimbal mount in combination, that is easily constructed.

A further object of the invention is to provide a shipping carton with a gimbal structure which can be knocked down, re-used, or converted to other end uses.

These and other objects are attained by a shipping container comprising a hexagonal carton having six walls extending between top and bottom ends of the carton, and a gimbal assembly contained within the carton and supported only by pivot connections to an opposed pair of the walls. The gimbal assembly comprises a normally horizontal ring supported by the pivot connections to the side walls, and a normally vertical cradle pivotally connected at diametrically opposed points to the ring. The cradle includes an integral product platform below its pivot axis. Since the cradle and the product platform have a combined center of gravity below the pivot axis, the cradle tends to remain in a vertical plane regardless of how the carton is turned.

According to another aspect of the invention, the top and bottom ends are preferably formed by six triangular flaps each slightly oversize, so that the flaps toggle to a locked, non-coplanar position upon closure.

BRIEF DESCRIPTION OF THE DRAWINGS

In the accompanying drawings.

DESCRIPTION OF THE PREFERRED EMBODIMENT

Figure 1:
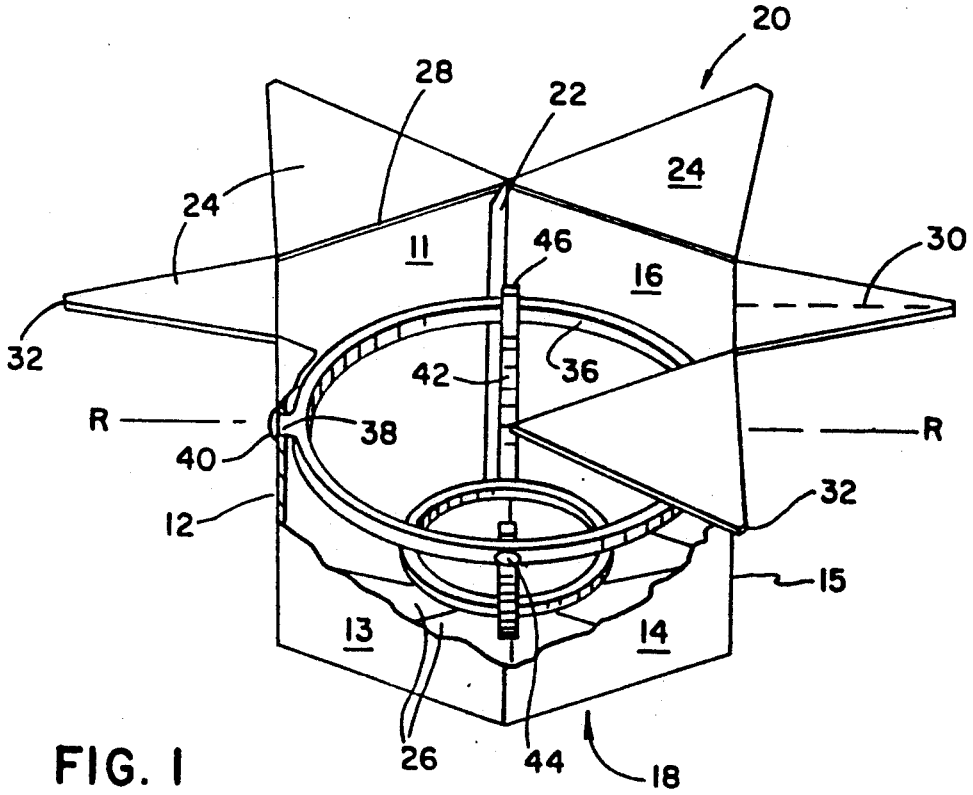
FIG. 1 is a perspective view of an open carton and gimbal assembly embodying the invention.
Figure 2:
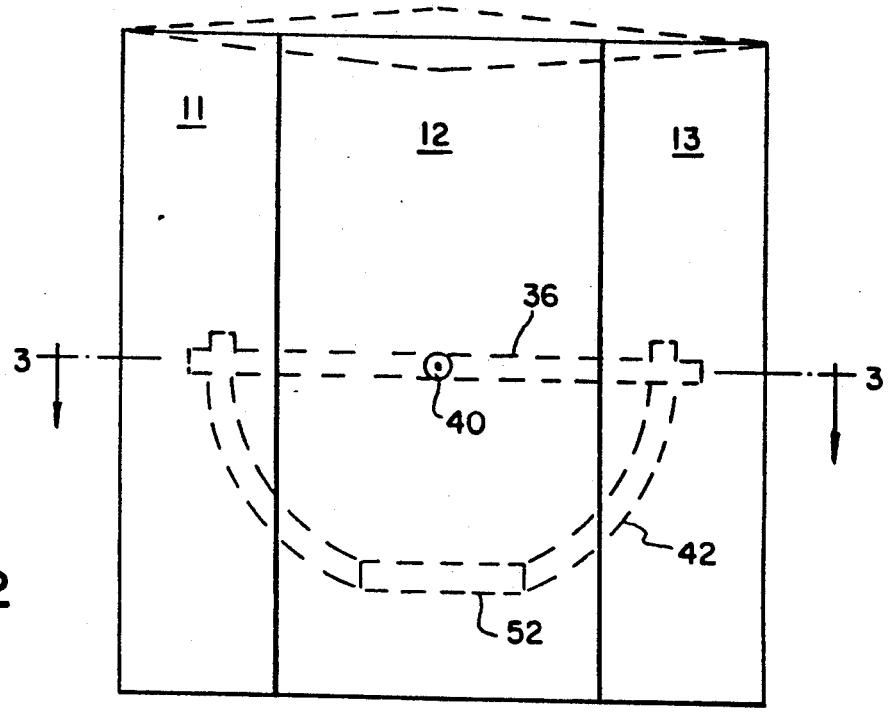
FIG. 2 is a side elevation thereof, showing the carton closed.
Figure 3:
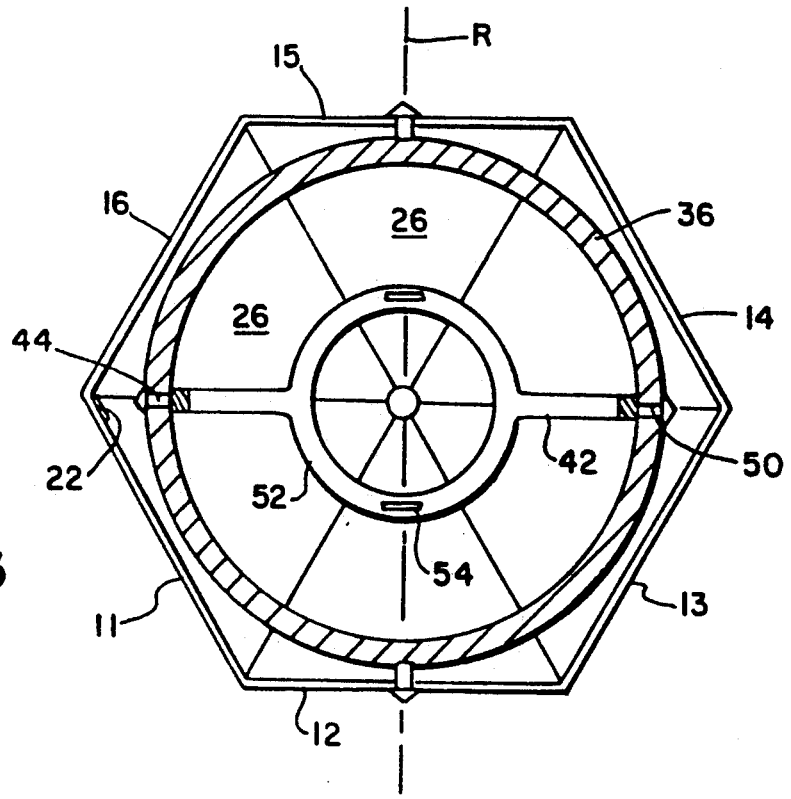
FIG. 3 is a sectional view taken along the line 3—3 in FIG. 2.

A shipping carton embodying the invention, as shown in FIG. 1, has six like rectangular walls 11–16, joined along their edges to form a regular hexagonal prism bounded by a bottom 18 and a top 20. A vertical seam 21 is formed between two of the walls, one (16) of which has a tab 22 extending its full length, which is joined, preferably by adhesive, to the inner surface of the neighboring wall (11).

The bottom 18 of the carton is preferably formed from six identical triangular flaps 24, each of which is integral with a respective one of the walls, being bent about 90° inward from its wall toward the vertical axis A of the carton. Similarly, six triangular flaps 26 extend inwardly from the top edges 28 of the walls. The apexes of the triangular flaps, top and bottom, meet at or near the longitudinal axis A of the carton, which is vertical when the carton is upright.

It is preferred that the altitude 30 of each flap 24, 26 be slightly greater than the horizontal distance from the axis to each wall, so that there is a slight interference fit between adjacent flaps. This way, the flaps meet, as the carton is closed, slightly before they reach the horizontal plane P containing the edges 28. Pushing them downward springs the box outward slightly, stressing shrink-wrap material (not shown) surrounding the carton, thus producing a toggling action so that the flaps come to rest below the plane P and will remain in that closed position until an opening force is applied. The bottom flaps are similarly constructed.

Each triangular flap is preferably slightly truncated —see reference numeral 32—so that a hole results at the center of the top and bottom, into which one may insert a finger to open the carton.

The gimbal assembly within the carton comprises a ring 36 having a horizontal axis R defined by a first pair of diametrically opposed, integral lugs 38, having annular barbs 40, for pivotally connecting the ring to the walls 12 and 15. Each of these walls has a central hole whose diameter is larger than that of the lug, so that the ring can rotate freely about the lug axis, but slightly smaller than that of the barb, so that the barb can be pushed through the hole from inside, and thereafter acts a retainer.

The other major element of the gimbal 34 is a semicircular cradle, 42 having diametrically opposed pins 44 near its ends 46. Prior to assembly, the outer diameter of cradle 42 is slightly greater than the inner diameter of the ring 32, so that there all is a slight preload between the parts that tends to keep them assembled. The cradle 42 is supported within the ring 36 by the pins 44, which are similar to the lugs 34, and extend through diametrically opposed holes 50 in the ring, that define a normally horizontal axis Q perpendicular to axis R. The center of gravity of the cradle 42 is below the axis Q, so that the cradle tends to remain in a vertical plane regardless of how the box is oriented.

The ring 36 and cradle 42 are preferably made from injection-molded polyethylene, which is inexpensive, strong and light. Other materials may be substituted, if desired.

Figure 4:
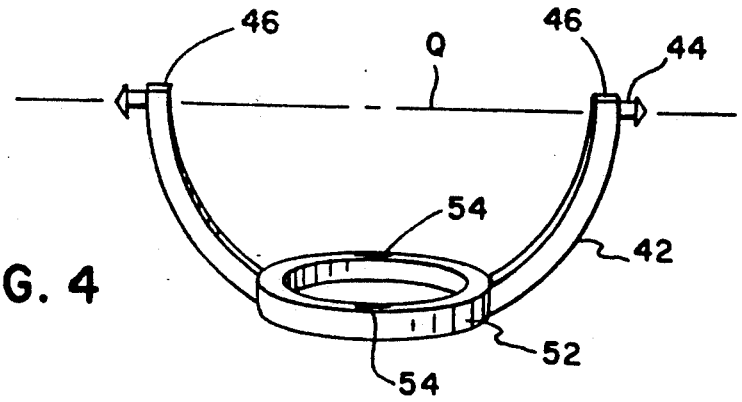
FIG. 4 is a perspective view of the cradle component of the gimbal assembly.

A product platform 52 is formed at the center of the cradle 42, between its ends 46. A preferred form of the platform is shown in FIG. 4, as an integral circular loop for receiving, for example, a flower pot. The platform is provided with a pair of slots 54, as shown, through which one can pass cable ties or other restraints for holding the product firmly to the platform.

In using the invention, it is of course important to place the product to be shipped on the platform in such a way that the goods, platform and cradle 42 have a combined center of gravity below the axis Q. Otherwise, the self-righting effect of the gimbal will not result. Placing the product platform at the very bottom of cradle 42 keeps the center of gravity as low as possible, so that additional ballast will not be required in most situations.

The construction described above provides several advantages. First, it is possible to ship the empty cartons in a knock-down configuration to the point of assembly; conversely, after the carton has been emptied, it and the gimbal assembly can both be easily knocked down for storage pending re-use. The closure arrangement minimizes or obviates the need for adhesive application, again prolonging the life of the carton.

Figure 5:
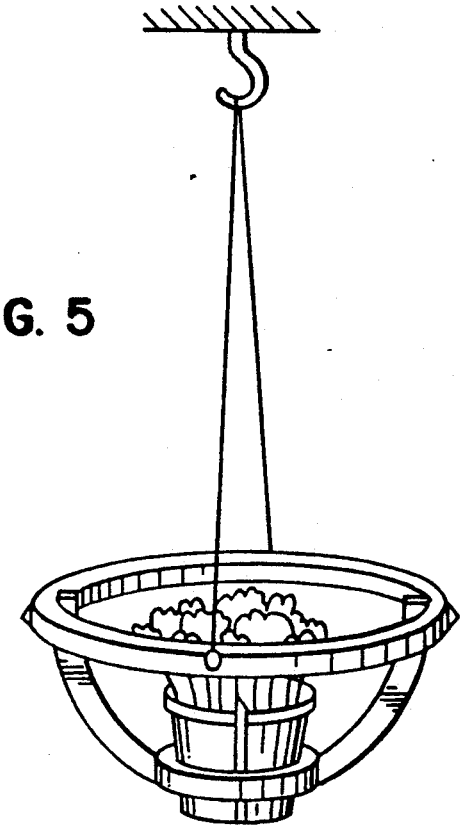
FIGS. 5 and 6 show two supplemental uses for the gimbal assembly sans carton.
Figure 6:
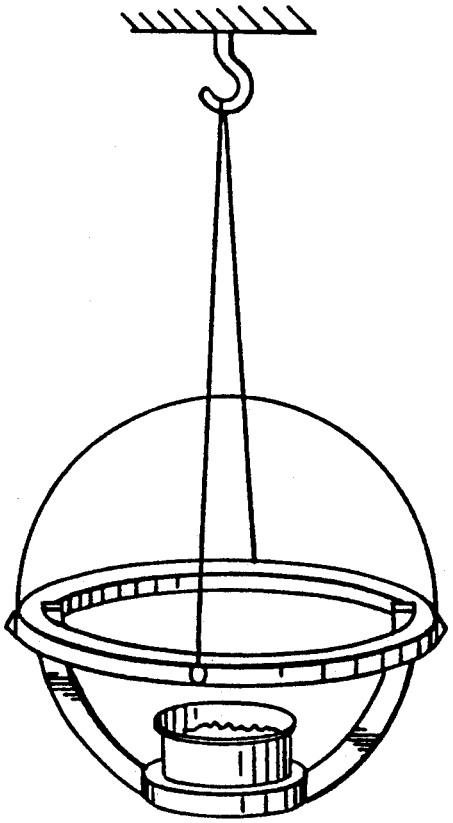

We have found also that the gimbal assembly, once removed from the carton, can be suspended from a hook and used as a planter (FIG. 5); or, with the addition of a clear canopy and seed holder, as shown in FIG. 6, it can serve as a squirrel-prool bird feeder.

The invention is subject to variations. For example, the ring mounting holes need not be in the centers of their respective walls. They could be above or below center, as desired, or they could be along the fold lines between adjacent walls. The barbed lugs described could be replaced by some other pivotable connections, and the cradle could extend over more than 180°. The cradle, and the ring 36, need not necessarily be circular.

Also, while a hexagonal container is preferred, because it closely conforms to the geometry of the ring 36, and has a high packing density with like containers, cartons with greater or fewer walls (e.g., four or eight) could be constructed according to this invention.

Since the invention is subject to these and other modifications, it is intended that the foregoing description and the accompanying drawings shall be interpreted as only illustrative of only one form of the invention, whose scope is to be measured by the following claims.

I claim:

1. A shipping container comprising a carton having a plurality of interconnected walls each parallel to common longitudinal axis so as to form a right polygonal prism having a top end and a bottom end, means for closing said top end, means for closing said bottom end, a gimbal assembly contained within said carton and supported only by a first pair of pivot connections to an opposed pair of said walls, said gimbal assembly comprising a normally horizontal ring supported by said pivot connections, a normally vertical cradle pivotally connected at diametrically opposed points defining a horizontal axis to said ring by a second pair of pivot connections, said cradle comprising a product platform below said horizontal axis, intermediate said opposed points, so that the cradle and product platform have a combined center of gravity below said horizontal axis, whereby the cradle tends to remain in a vertical plane regardless of orientation of the carton, wherein each of said first pivot connections comprises a lug which extends outward from the ring through a respective hole in one of said walls, and has means for retaining said lug in said hole.

2. The invention of claim 1, wherein said walls are identical and form a regular polygonal prism.

3. The invention of claim 2, wherein there are six walls forming a regular hexagonal prism.

4. The invention of claim 3, wherein said means for closing said top carton end comprises a plurality of triangular flaps, each folded inwardly from a top edge of a respective wall toward said longitudinal axis, and each having an altitude slightly greater than the distance from said axis to its respective wall, whereby said flaps interfere upon closure and toggle to a locked position slightly below a plane containing said top edges.

5. The invention of claim 3, wherein said means for closing said bottom carton end comprises a plurality of triangular flaps, each folded inwardly from a bottom edge of a respective wall toward said longitudinal axis, and each having an altitude slightly greater than the distance from said axis to its respective wall, whereby said flaps interfere upon closure and toggle to a locked position slightly above a plane containing said bottom edges.

6. The invention of claim 1, wherein each of said second pivot connections comprises a pin extending from said cradle through a respective hole in said ring.

7. The invention of claim 6, wherein prior to assembly cradle has an outside diameter slightly greater than the inside diameter of said ring, so that there is a slight preload which tends to keep the cradle and the ring assembled.

8. The invention of claim 1, wherein each of the lugs extending from said ring comprises a barb which is pushed through its respective hole in the carton wall, but resists withdrawal therefrom.

* * * * *